US005438352A

United States Patent [19]

Agano

[11] Patent Number: 5,438,352

[45] Date of Patent: Aug. 1, 1995

[54] METHOD OF AND APPARATUS FOR RECORDING AN IMAGE IN A FIRST DIRECTION WHILE THE RECORDING MEANS IS BEING RELATIVELY MOVED AND THE IMAGES BEING DISPERSED IN A SECOND DIRECTION WHICH IS SUBSTANTIALLY PARALLED TO THE FIRST DIRECTION

[75] Inventor: Toshitaka Agano, Kanagawa, Japan

[73] Assignee: Fuji Photo Film Co., Ltd., Kanagawa, Japan

[21] Appl. No.: 285,034

[22] Filed: Aug. 2, 1994

[30] Foreign Application Priority Data

Aug. 2, 1993 [JP] Japan ..... 5-191317

[51] Int. Cl.[6] ..... B41J 2/35

[52] U.S. Cl. ..... 347/183; 347/10; 347/11; 347/15; 358/298

[58] Field of Search ..... 346/76 PH, 76 L; 358/298; 400/120; 347/10, 11, 15, 183

[56] References Cited

U.S. PATENT DOCUMENTS 4,691,211 9/1987 Brownstein ..... 346/76 PH
4,745,413 5/1988 Brownstein et al. ..... 346/76 PH
4,933,686 6/1990 Izumi et al. ..... 346/76 PH
5,075,698 12/1991 Aoki et al. ..... 347/15
5,232,294 8/1993 Inui ..... 358/298
5,297,878 3/1994 Saito et al. ..... 346/76 PH
5,305,024 4/1994 Moriguchi et al. ..... 347/11
5,363,125 11/1994 Inui et al. ..... 346/76 PH

*Primary Examiner*—Huan H. Tran
*Attorney, Agent, or Firm*—Sughrue, Mion, Zinn, Macpeak & Seas

[57] ABSTRACT

Image data representing one pixel line and supplied from a line memory are divided by a dividing circuit into three sets of image data which are stored in respective line memories. A switcher is controlled by a timing signal from a controller to successively supply the image data from the line memories to a thermal head driver. Based on the supplied image data, the thermal head driver enables a thermal head to record three lines on a thermosensitive recording medium. The thermosensitive recording medium now records thereon a high-quality image free of coarse image textures which has recorded image areas dispersed in one pixel interval in the direction in which the thermosensitive recording medium is fed.

14 Claims, 17 Drawing Sheets

D=1
D=2
D=3
D=4
D=5
t
2t
ONE PIXEL INTERVAL IN FEED DIRECTION
a
b

FIG. 7

| IMAGE DATA | 0 | | 1 | | 401 | | 1020 | | 1023 | |
|---|---|---|---|---|---|---|---|---|---|---|
| | ADDRESS | DIVIDED IMAGE DATA | ADDRESS | DIVIDED IMAGE DATA | ADDRESS | DIVIDED IMAGE DATA | ADDRESS | DIVIDED IMAGE DATA | ADDRESS | DIVIDED IMAGE DATA |
| 0TH LINE | 0 | 0 | 4 | 0 | 1605 | 100 | 4081 | 255 | 4092 | 255 |
| 1ST LINE | 1 | 0 | 5 | 0 | 1606 | 100 | 4082 | 255 | 4093 | 255 |
| 2ND LINE | 2 | 0 | 6 | 0 | 1607 | 100 | 4083 | 255 | 4094 | 255 |
| 3RD LINE | 3 | 0 | 7 | 1 | 1608 | 101 | 4084 | 255 | 4095 | 255 |

FIG.9

| IMAGE DATA | 1 | 3 | 401 | 1020 | 2 | 0 |
|---|---|---|---|---|---|---|
| DIVIDED IMAGE DATA FOR 0TH LINE | 0 | 0 | 100 | 255 | 0 | 0 |
| DIVIDED IMAGE DATA FOR 1ST LINE | 0 | 1 | 100 | 255 | 0 | 0 |
| DIVIDED IMAGE DATA FOR 2ND LINE | 0 | 1 | 100 | 255 | 1 | 0 |
| DIVIDED IMAGE DATA FOR 3RD LINE | 1 | 1 | 101 | 255 | 1 | 0 |

FIG.15

| IMAGE DATA | 1 | 3 | 401 | 1020 | 2 | 0 |
|---|---|---|---|---|---|---|
| DIVIDED IMAGE DATA FOR 0TH LINE | 0 | 0 | 0 | 255 | 0 | 0 |
| DIVIDED IMAGE DATA FOR 1ST LINE | 0 | 0 | 100 | 0 | 0 | 0 |
| DIVIDED IMAGE DATA FOR 2ND LINE | 0 | 1 | 0 | 255 | 0 | 0 |
| DIVIDED IMAGE DATA FOR 3RD LINE | 0 | 0 | 100 | 0 | 0 | 0 |
| DIVIDED IMAGE DATA FOR 4TH LINE | 0 | 1 | 0 | 255 | 0 | 0 |
| DIVIDED IMAGE DATA FOR 5TH LINE | 0 | 0 | 0 | 0 | 0 | 0 |
| DIVIDED IMAGE DATA FOR 6TH LINE | 0 | 1 | 0 | 255 | 0 | 0 |
| DIVIDED IMAGE DATA FOR 7TH LINE | 1 | 0 | 101 | 0 | 1 | 0 |

METHOD OF AND APPARATUS FOR RECORDING AN IMAGE IN A FIRST DIRECTION WHILE THE RECORDING MEANS IS BEING RELATIVELY MOVED AND THE IMAGES BEING DISPERSED IN A SECOND DIRECTION WHICH IS SUBSTANTIALLY PARALLED TO THE FIRST DIRECTION

BACKGROUND OF THE INVENTION

1. Field of the Invention

The present invention relates to a method of and an apparatus for dispersing image data on a recording medium in an auxiliary scanning direction to record an image on the recording medium when the recording medium is scanned in a main scanning direction while it is being fed in the auxiliary scanning direction.

2. Description of the Related Art

There have heretofore been widely used image recording apparatus for recording an image on a recording medium with a thermal head, a laser beam, etc. In such an image recording apparatus, a thermosensitive recording medium is pressed against a linear thermal head composed of a one-dimensional array of heating elements, for example, and the thermosensitive recording medium is fed in a direction substantially normal to the one-dimensional array of heating elements while at the same time the heating elements are being individually controlled depending on supplied image data, thereby recording a desired two-dimensional gradation image on the thermosensitive recording medium.

Such a gradation image is formed as shown in FIG. 17A of the accompanying drawings. An image having a density D=1 is formed by heating a heating element for t seconds. An image having a density D=2 is formed by heating a heating element for 2t seconds. Similarly, images having respective densities D=3~5 are formed by heating a heating element for 3t ~5t seconds, respectively. As a result, as shown in FIG. 17B of the accompanying drawings, pixels having different colored areas according to the respective densities are formed within one pixel interval in the direction in which the thermosensitive recording medium is fed (hereinafter referred to as a "feed direction"), thus recording a gradation image on the thermosensitive recording medium. In this example, the pixels shown in FIG. 17B are formed according to pulse-width modulation. However, the pixels shown in FIG. 17B may be formed according to pulse-number modulation.

When the gradation image is recorded on the thermosensitive recording medium in the above manner, each of the pixels starts being recorded from a point "a", with an unrecorded area left to a point "b" within the pixel interval in the feed direction. Therefore, the recorded image tends to concentrate on the side of the point "a". When the formed two-dimensional gradation image is observed in its entirety, it looks relatively coarse.

SUMMARY OF THE INVENTION

It is an object of the present invention to provide a method of and an apparatus for recording an image of high quality which is free of undesirable coarse or rough textures by dispersing and recording image data.

According to the present invention, the above object can be achieved by a method of recording an image on a recording medium, comprising the steps of recording an image on a recording medium in a first one-dimensional direction with an image recording means and moving either the recording medium or the recording means in a second direction substantially perpendicular to the first one-dimensional direction, dividing gradation image data of pixels of the image into a plurality of substantially equal sets of image data, and dispersing the image in the second direction based on the substantially equal sets of image data, thereby to record the image on the recording medium.

According to the present invention, the above object can also be achieved by an image recording apparatus comprising image recording means for recording an image in a first one-dimensional direction on a recording medium, moving means for moving either the recording medium or the image recording means in a second direction substantially perpendicular to the first one-dimensional direction, image data dividing means for dividing image data of pixels of the image into a plurality of substantially equal sets of image data, divided image data memory means for storing the divided sets of image data, image data selecting means for selecting image data stored in the divided image data memory means depending on a recording position in the second direction, and means for supplying the image data selected by the image data selecting means to the image recording means to record the image on the recording medium.

According to the present invention, the above object can further be achieved by an image recording apparatus comprising image recording means for recording an image in a first one-dimensional direction on a recording medium, moving means for moving either the recording medium or the image recording means in a second direction substantially perpendicular to the first one-dimensional direction, divided image data memory means for dividing all image data which can be represented by pixels of the image into a plurality of substantially equal sets of image data, and storing the divided sets of image data for each recording line in the first one-dimensional direction, selective signal generating means for generating a selective signal to select a recording line for the divided image data, image data memory means for storing the image data of the pixels of the image, and means for selecting and supplying divided image data in the divided image data memory means to the image recording means based on the image data from the image data memory means and the selective signal from the selective signal generating means, thereby to record the image on the recording medium.

With the above image recording method and apparatus, image data representing one pixel line and supplied from a line memory are divided into a plurality of sets of image data, and the divided image data are dispersed and recorded in the direction in which the recording medium is fed. Recorded image areas are prevented from concentrating on certain regions, so that a high-quality image free of coarse image textures can be recorded on the recording medium.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 7 is a diagram showing divided image data stored in a divided image data memory in the image recording apparatus shown in FIG. 6;

FIG. 9 is a diagram showing data recorded based on the divided image data shown in FIG. 7;

FIG. 15 is a diagram showing data recorded by the image recording apparatus shown in FIG. 13;

DETAILED DESCRIPTION OF THE PREFERRED EMBODIMENTS

Figure 1:
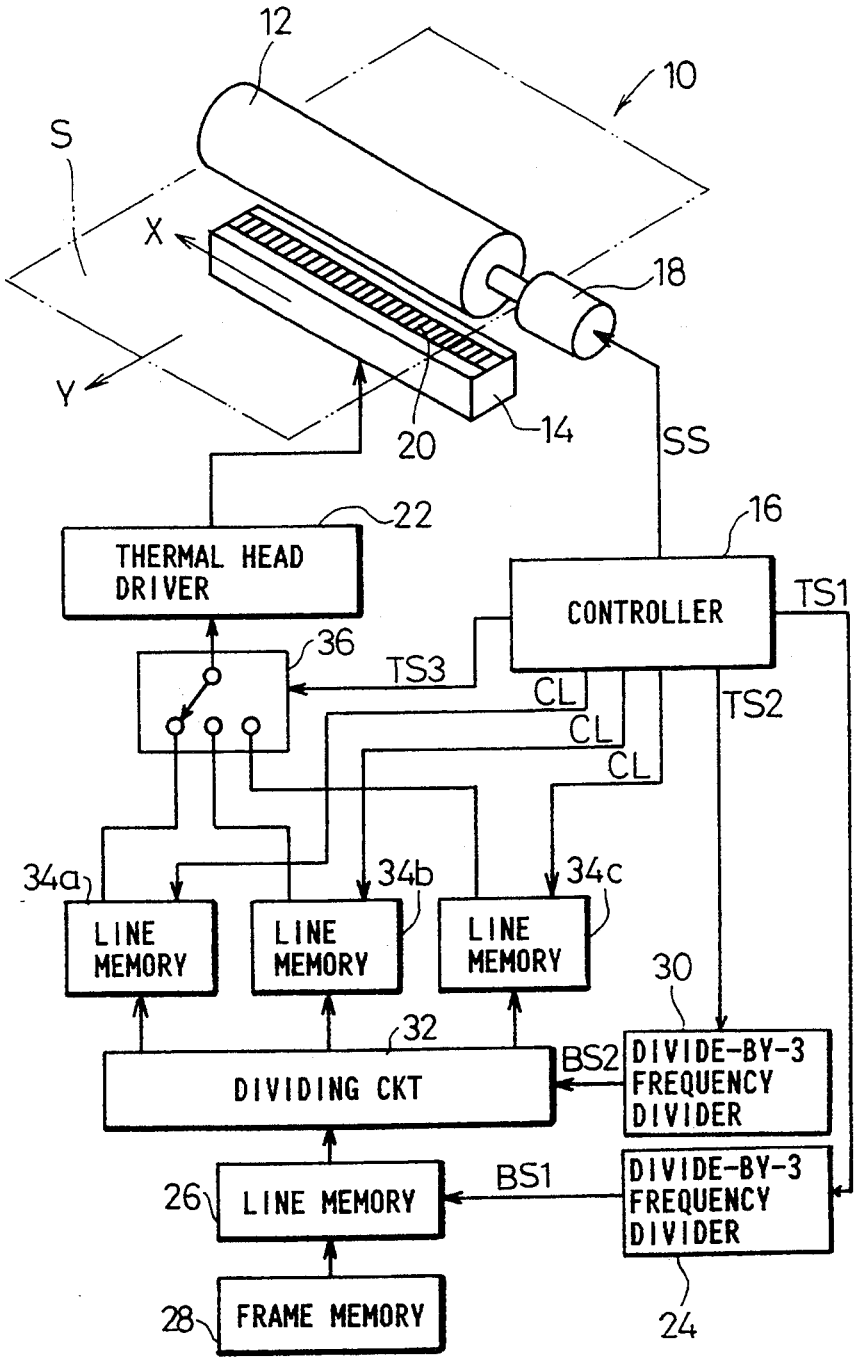
FIG. 1 is a block diagram of an image recording apparatus with a thermal head in which the principles of the present invention are embodied.

FIG. 1 shows an image recording apparatus 10 with a thermal head in which the principles of the present invention are embodied. As shown in FIG. 1, the image recording apparatus 10 records a two-dimensional gradation image on a sheet-like thermosensitive recording medium S which is fed in the direction indicated by the arrow Y while being sandwiched between a platen roller 12 and a thermal head 14 (image recording means).

The platen roller 12 is rotated by a step motor 18 (moving means) controlled by a controller 16 to feed the thermosensitive recording medium S in the direction Y. The thermal head 14 comprises a one-dimensional or linear array of heating elements 20 arrayed in the direction indicated by the arrow X which is perpendicular to the direction Y. The heating elements 20 can be heated by drive signals supplied from a thermal head driver 22 to enable the thermosensitive recording medium S to be colored in given gradations.

The controller 16 supplies a drive signal SS to the step motor 18 and also outputs timing signals TS1~TS3 corresponding to the drive signal SS and a readout clock signal CL. The controller 16 functions as a recording position detecting means for detecting an image recording position where an image is recorded by the thermal head 14, based on the timing signals TS1~TS3.

The timing signal TS1 is supplied to a divide-by-3 frequency divider 24, which supplies a frequency-divided signal BS1 having a frequency that is one third of the frequency of the timing signal TS1 to a line memory 26. The line memory 26 reads, from a frame memory 28, one-dimensional image data to be recorded on the thermosensitive recording medium S in the direction X, according to the frequency-divided signal BS1. The timing signal TS2 is supplied to a divide-by-3 frequency divider 30 while being delayed one pulse from the timing signal TS1. The divide-by-3 frequency divider 30 supplies a frequency-divided signal BS2 having a frequency that is one third of the frequency of the timing signal TS2 to a dividing circuit 32. As described later on, the dividing circuit 32 divides image data read from the line memory 26 into three substantially equal sets of image data according to the frequency-divided signal BS2, and supplies them as three one-dimensional sets of image data to respective line memories 34*a*, 34*b*, 34*c* (divided image data memory means). The timing signal TS3 is supplied to a switcher 36 (image data selecting means) while being delayed one pulse from the timing signal TS2. The switcher 36 is connected between the thermal head driver 22 and the line memories 34*a*~34*c*, and selectively connects the line memories 34*a*~34*c* to the thermal head driver 22 according to the timing signal TS3. The line memories 34*a*~34*c* are supplied with the readout clock signal CL from the controller 16.

Figure 2:
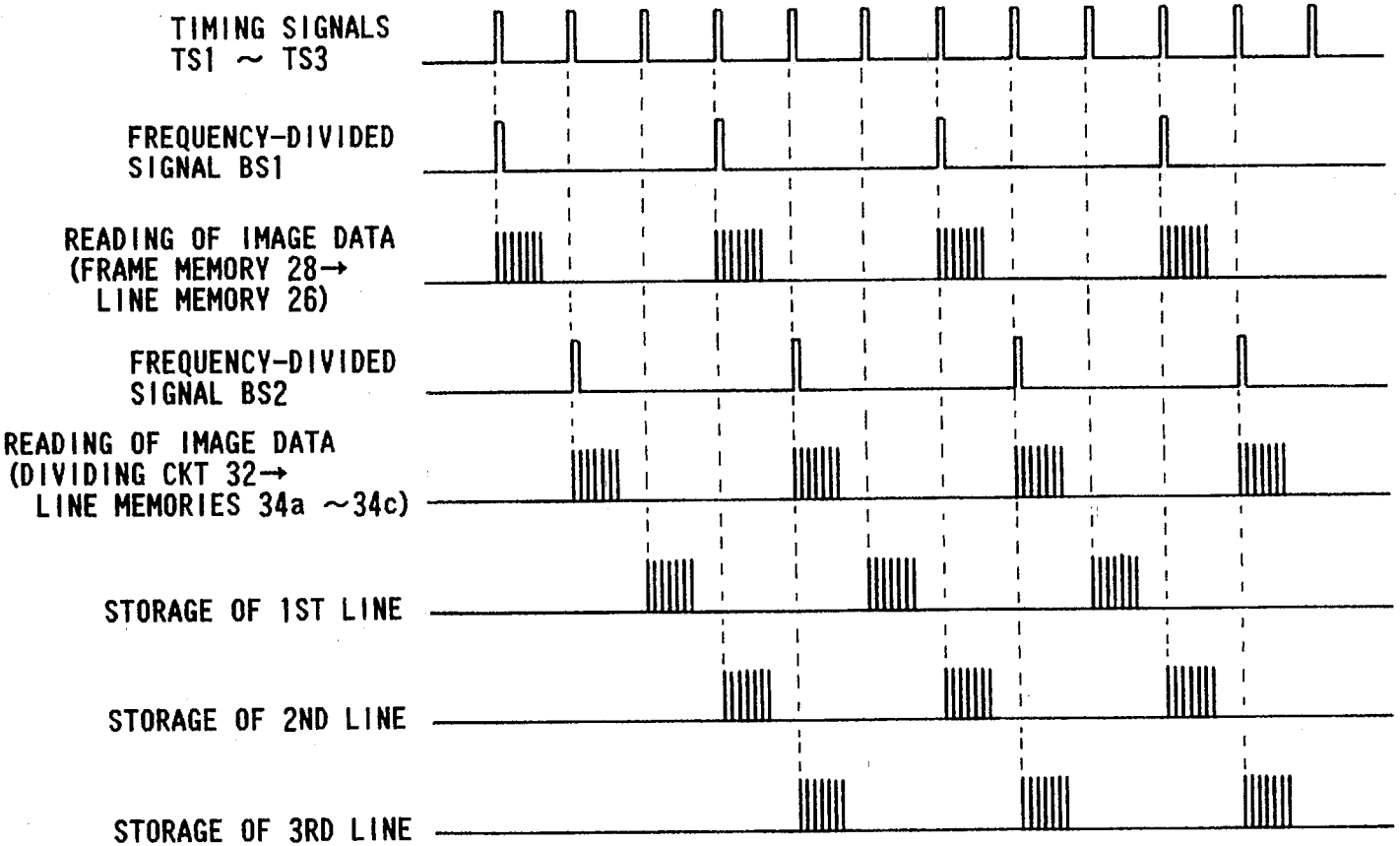
FIG. 2 is a timing chart of signals in the image recording apparatus shown in FIG. 1.

The image recording apparatus 10 is basically constructed as described above. Operation of the image recording apparatus 10 will be described below with reference to a timing chart shown in FIG. 2.

The controller 16 outputs a drive signal SS to the step motor 18, which is energized to rotate the platen roller 12 for thereby feeding the thermosensitive recording medium S in the direction Y. The controller 16 also generates timing signals TS1~TS3 in synchronism with or proportion to the drive signal SS, and supplies the timing signals TS1~TS3 to the divide-by-3 frequency dividers 24, 30 and the switcher 36.

The divide-by-3 frequency divider 24 divides the frequency of the timing signal TS1 by 3, and supplies a frequency-divided signal BS1 to the line memory 26. Based on the frequency-divided signal BS1, the line memory 26 reads one-dimensional image data from the frame memory 28, and temporarily stores the read one-dimensional image data. The divide-by-3 frequency divider 30 divides the frequency of the timing signal TS2, which is delayed one pulse from the timing signal TS1, by 3, and supplies a frequency-divided signal BS2 to the dividing circuit 32. Based on the frequency-divided signal BS2, the dividing circuit 32 reads the one-dimensional image data from the line memory 26, and generates three substantially equal sets of one-dimensional image data from the one-dimensional image data read from the line memory 26.

A process of generating three substantially equal one-dimensional image data will be described below. The one-dimensional image data supplied from the line memory 26 comprise image data of as many pixels as the number of heating elements 20 of the thermal head 14. It is assumed that the image data are represented by D, the number of substantially equal sets of image data divided by the dividing circuit 32 is represented by N, and the divided image data of the divided N sets are represented by $d_1, d_2, \ldots, d_N$. The image data D are divided into substantially equal sets N of divided image data $d_1, d_2, \ldots, d_N$ based on the following relationship:

$$\begin{aligned} D &= d_1 + d_2 + \ldots + d_N \\ &= [D/N] + [(D - d_1)/(N - 1)] + \\ &\quad [(D - d_1 - d_2)/(N - 2)] + \ldots + \\ &\quad [(D - d_1 - d_2 \ldots - d_{N-1})]. \end{aligned}$$

For example, if N=3, then $(d_1, d_2, d_3)=(1, 0, 0)$ for D=1, $(d_1, d_2, d_3)=(1, 1, 0)$ for D=2, $(d_1, d_2, d_3)=(1, 1, 1)$ for D=3, $(d_1, d_2, d_3)=(2, 1, 1)$ for D=4, and $(d_1, d_2, d_3)=(2, 2, 1)$ for D=5.

The divided image data $d_1, d_2, d_3$ thus generated are stored as one-dimensional image data in the line memories 34*a*~34*c*, respectively. The controller 16 controls the switcher 36 according to the timing signal TS3, which is delayed one pulse from the timing signal TS2, to supply the divided image data $d_1, d_2, d_3$ stored in the line memories 34*a*~34*c* successively to the thermal head driver 22. The thermal head driver 22 supplies the heating elements 20 of the thermal head 14 with drive currents based on the divided image data $d_1$ from the line memory 34*a* for thereby recording a one-dimensional image or one line on the thermosensitive recording medium S in the direction X. Then, the thermal head driver 22 supplies the heating elements 20 successively with drive currents based on the divided image data $d_2, d_3$ from the line memories 34*b*, 34*c* for thereby recording additional two lines on the thermosensitive recording medium S in the direction X. As a result, three lines represented by the three substantially equal sets of divided image data $d_1, d_2, d_3$ divided from the image data D are recorded on the thermosensitive recording medium S within one pixel interval in the feed direction thereof.

Figures 3A, 3B:
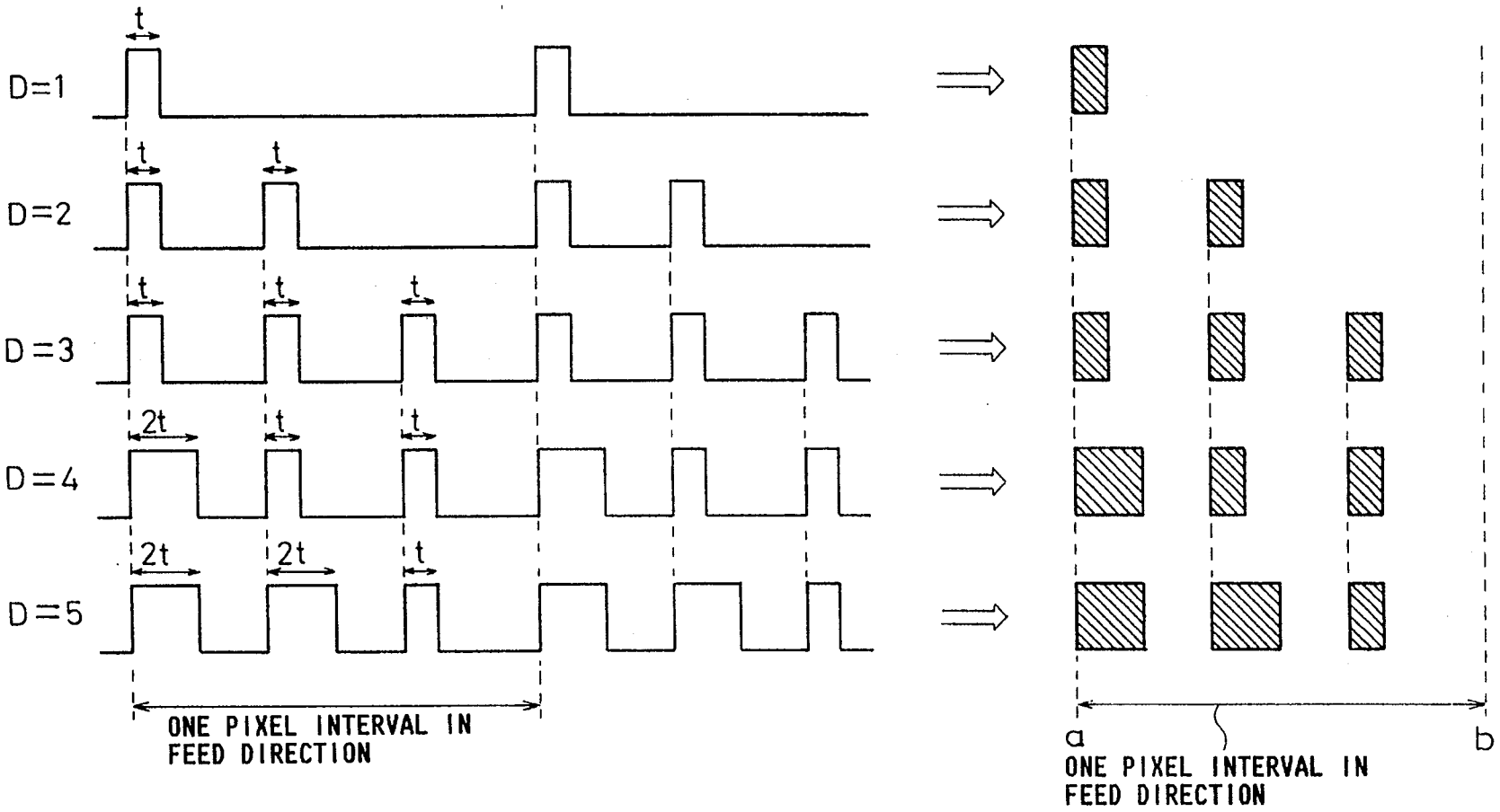
FIG. 3A is a diagram illustrative of drive signals produced when image data are pulse-width-modulated according to the present invention.
FIG. 3B is a diagram illustrative of an image produced by the drive signals shown in FIG. 3A.

FIG. 3A shows drive currents produced by the thermal head driver 22 when the divided image data $d_1, d_2, d_3$ (D=1~5) supplied from the line memories 34*a*~34*c* are pulse-width-modulated where "t" is a unit recording time. Based on the drive currents thus produced, images as shown in FIG. 3B is recorded on the thermosensitive recording medium S. Since the images are dispersed and recorded on the thermosensitive recording medium S within one pixel interval in the feed direction thereof, without being unduly displaced to or concentrating on the side of a recording start point "a" or a recording end point "b", there is produced a high-quality image free of coarse image textures.

Figure 4:
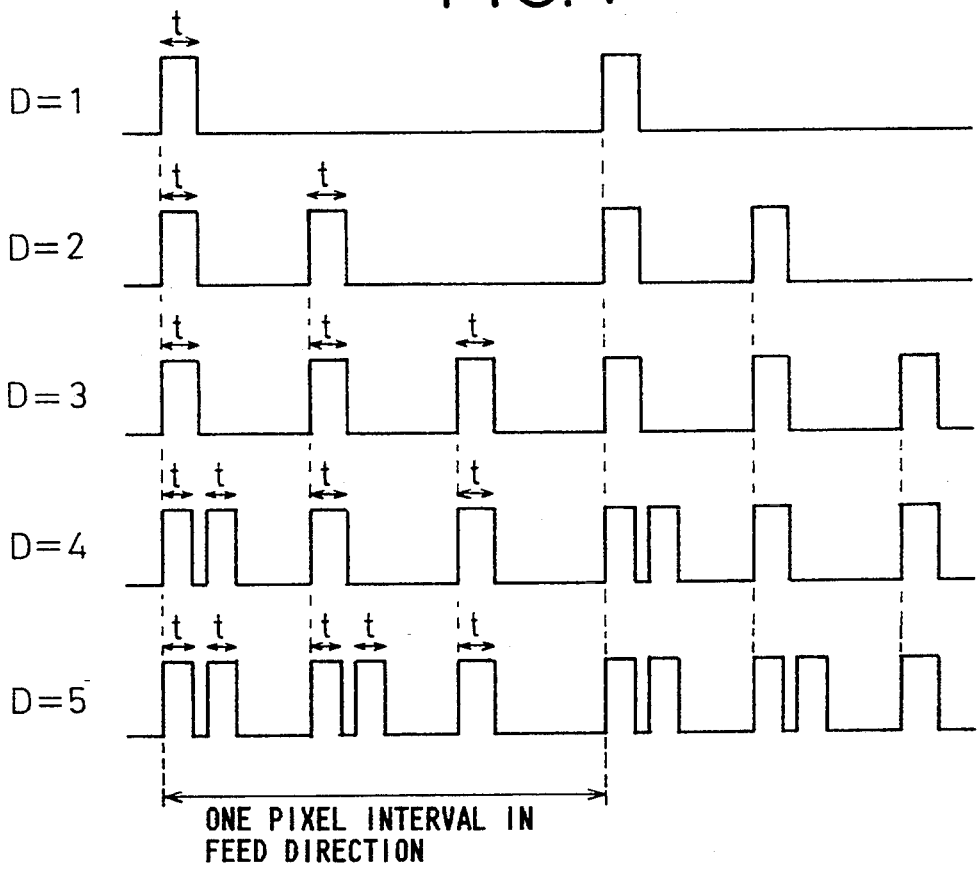
FIG. 4 is a diagram illustrative of drive signals produced when image data are pulse-number-modulated according to the present invention.

FIG. 4 shows drive currents produced by the thermal head driver 22 when the divided image data $d_1, d_2, d_3$ (D=1~5) supplied from the line memories 34*a*~34*c* are pulse-number-modulated where "t" is a unit recording time. Such pulse-number-modulated image data also allow a high-quality image free of coarse image textures to be produced as with the pulse-width-modulated image data.

Figure 5:
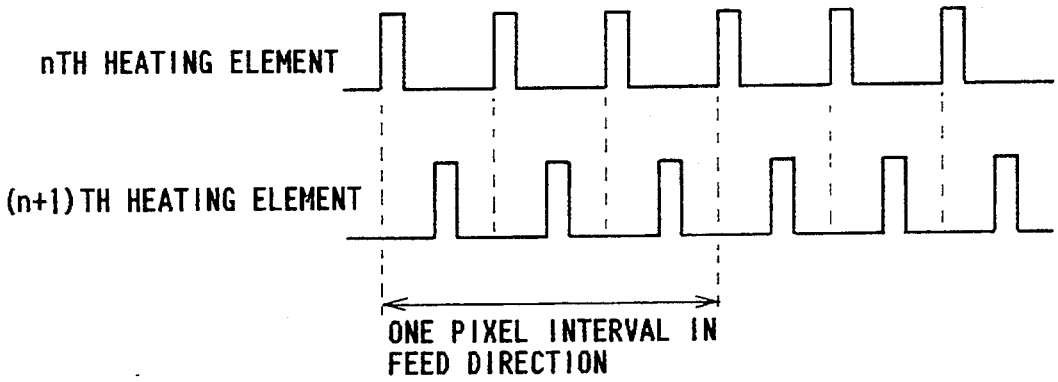
FIG. 5 is a diagram illustrative of drive signals supplied to adjacent heating elements for recording adjacent images as being shifted one from the other.

In addition to the above process, drive currents supplied to adjacent heating elements 20 of the thermal head 14 may be staggered or shifted in time with respect to each other as shown in FIG. 5 for producing a higher-quality image free of coarse image textures.

Figure 6:
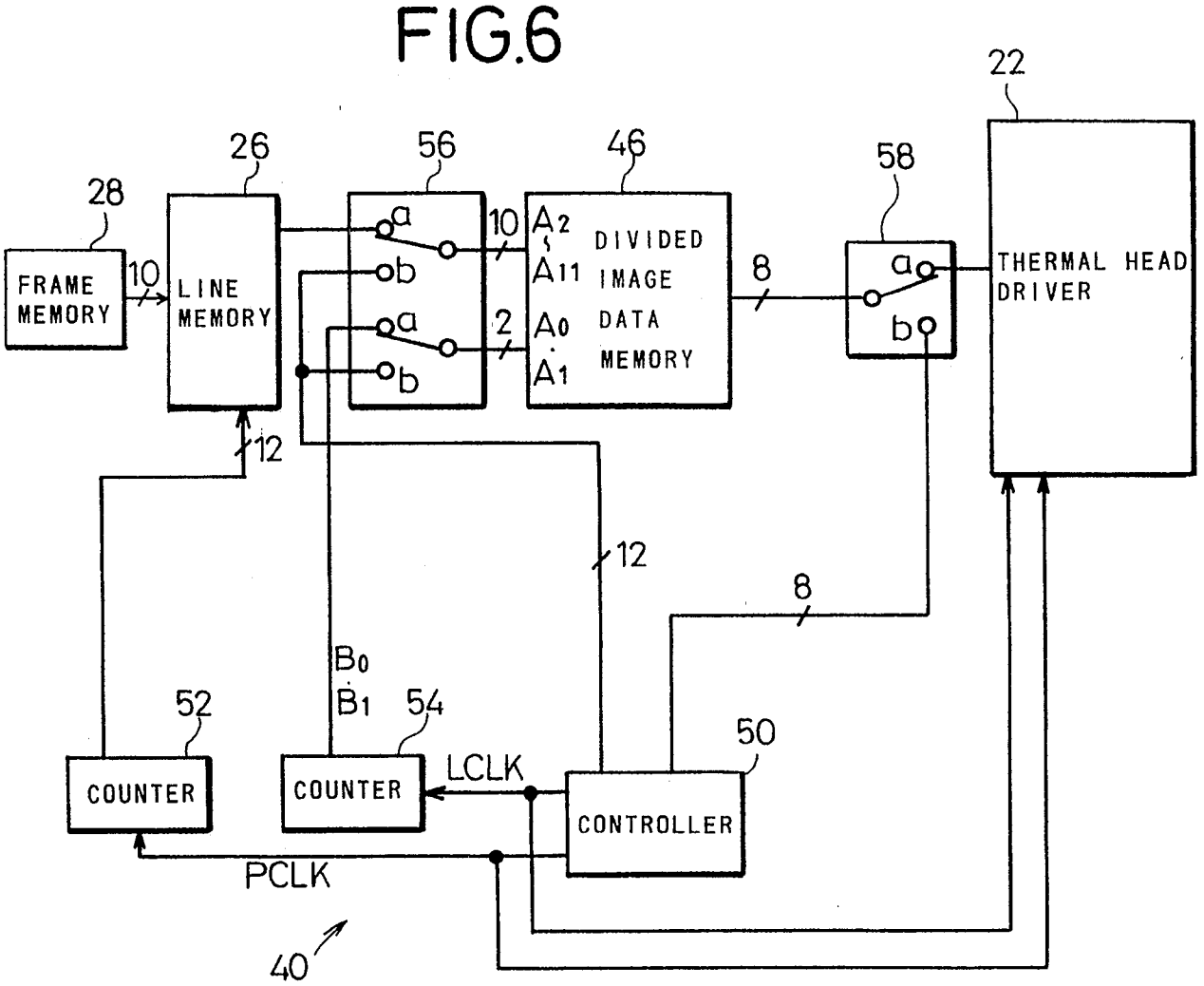
FIG. 6 is a block diagram of an image recording apparatus with a thermal head according to another embodiment of the present invention.

FIG. 6 shows in block form an image recording apparatus 40 with a thermal head according to another embodiment of the present invention. The image recording apparatus 40 comprises a line memory 26 for storing one-dimensional image data supplied from two-dimensional image data stored in a frame memory 28, a divided image data memory 46 for storing four substantially equal sets of divided image data which are produced from the one-dimensional image data stored in the line memory 26, a thermal head driver 22 for energizing a thermal head which is identical to the thermal head 14 shown in FIG. 1 based on the divided image data, and a controller 50 for controlling the line memory 26, the divided image data memory 46, and the thermal head driver 22. The line memory 26 outputs one-dimensional image data according to address data from a counter 52. The divided image data memory 46 outputs divided image data according to address data from a counter 54 and the one-dimensional image data from the line memory 26. Two switchers 56, 58 for storing divided image data in the divided image data memory 46 are connected between the line memory 26 and the divided image data memory 46 and between the divided image data memory 46 and the thermal head driver 22.

When the movable contacts of the switchers 56, 58 are connected to contacts "b" thereof, divided image data are transferred from the controller 50 into the divided image data memory 46, and stored therein. For example, if the one-dimensional image data supplied from the line memory 26 to the divided image data memory 46 are of 10 bits, the address data supplied from the counter 54 are of 2 bits, and the divided image data are 8 bits, then, as shown in FIG. 7, four divided image data 0, 0, 0, 0 (image data D=0), four divided image data 0, 0, 0, 1 (image data D=1), . . . , four divided image data 100, 100, 100, 101 (image data D=401), . . . , and four divided image data 255, 255, 255, 255 (image data D=1023) are successively stored in the divided image data memory 46 in response to 12-bit address data $A_0$~$A_{11}$. The address data $A_0$~$A_{11}$ include two low-order bits $A_0$, $A_1$ indicative of divided image data for a 0th line ($A_0=A_1=0$), a 1st line ($A_0=1$, $A_1=0$), a 2nd line ($A_0=0$, $A_1=1$), and a 3rd line ($A_0=A_1=1$) to be recorded on the thermosensitive recording medium S by the thermal head 14.

Figure 8:
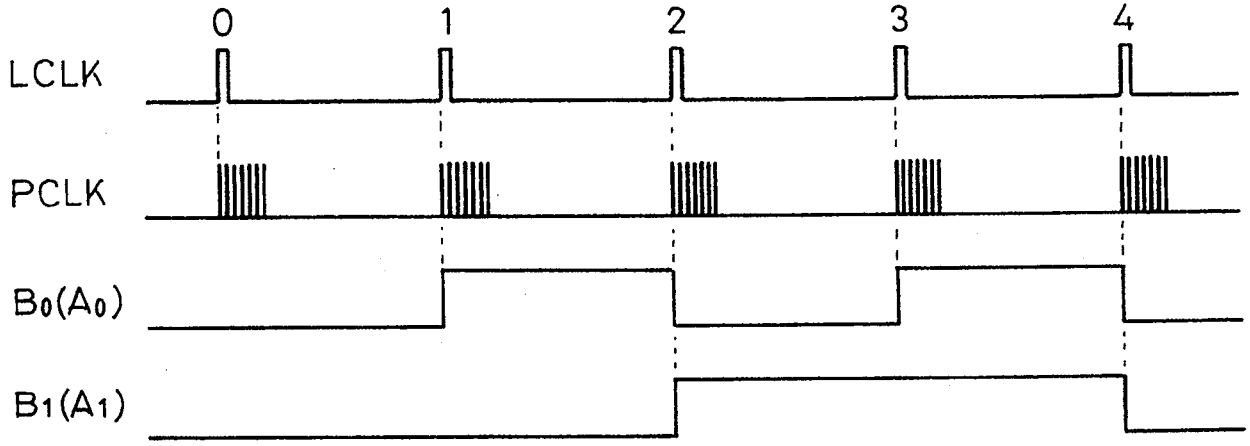
FIG. 8 is a timing chart of signals in the image recording apparatus shown in FIG. 6.

After the divided image data have been recorded in the divided image data memory 46, the movable contacts of the switchers 56, 58 are connected to contacts "a" thereof, and the image recording apparatus 40 starts recording an image according to a timing chart shown in FIG. 8.

First, the two-dimensional image data stored in the frame memory 28 are transferred, one-dimensional image data by one-dimensional image data to be recorded on the thermosensitive recording medium S, to the line memory 26 and stored therein.

Then, the controller 50 outputs a pixel clock signal PCLK to the counter 52. The counter 52 counts up clock pulses of the pixel clock signal PCLK to produce address data, and output the address data to the line memory 26. In response to the supplied address data, the line memory 26 outputs the one-dimensional image, pixel by pixel, which are supplied as address data through the switcher 56 to ten high-order bits $A_2 \sim A_{11}$ of the divided image data memory 46. The controller 50 also outputs a line clock signal LCLK to the counter 54. The counter 54 counts up clock pulses of the line clock signal LCLK, and supplies first and second data $B_0$, $B_1$, counted from the LSB, of the line clock signal LCLK as address data through the switcher 56 to two low-order bits $A_0$, $A_1$ of the divided image data memory 46.

Now, the divided image data memory 46 is supplied with 12-bit address data having ten high-order bits composed of one-dimensional image data before being divided and two low-order bits representing 0th through 3rd lines on the thermosensitive recording medium S. Therefore, if a 0th line of image data 1, 3, 401, 1020, 2, 0, . . . as shown in FIG. 9, for example, is to be recorded on the thermosensitive recording medium S, then the data $B_0$, $B_1$ outputted from the counter 54 are reset to 0 by the 0th line clock signal LCLK, and divided image data 0, 0, 100, 255, 0, 0 . . . stored in addresses whose two low-order bits of address data are $A_0=A_1=0$ are selected by the divided image data memory 46 and supplied through the switcher 58 to the thermal head driver 22. According to the supplied divided image data, the thermal head driver 22 energizes the thermal head 14 to record a 0th-line image on the thermosensitive recording medium S. Similarly, the address data of the two low-order bits $A_0$, $A_1$ in the divided image data memory 46 are successively updated according to the line clock signal LCLK for recording 1st-~3rd-line images on the thermosensitive recording medium S. As a result, a high-quality image composed of four recorded lines in one pixel interval in the feed direction is recorded on the thermosensitive recording medium S.

Figure 10A:
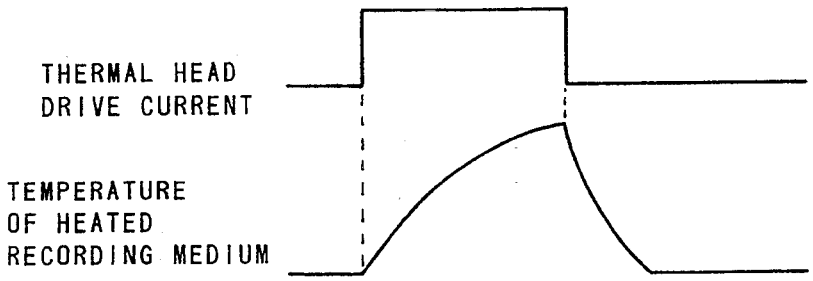
FIG. 10A is a diagram showing a thermal head drive current which is pulse-width-modulated and the temperature of a thermosensitive recording medium heated by the thermal head drive current.
Figure 10B:
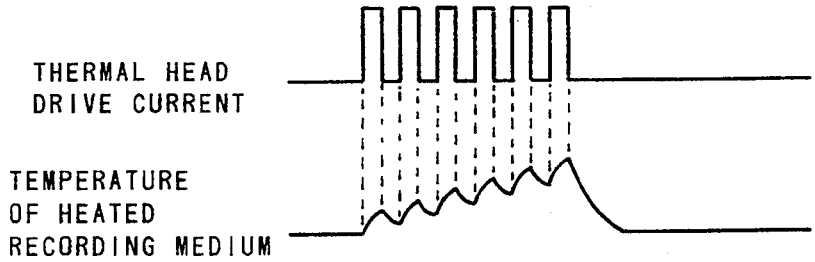
FIG. 10B is a diagram showing a thermal head drive current which is pulse-number-modulated and the temperature of a thermosensitive recording medium heated by the thermal head drive current.
Figure 10C:
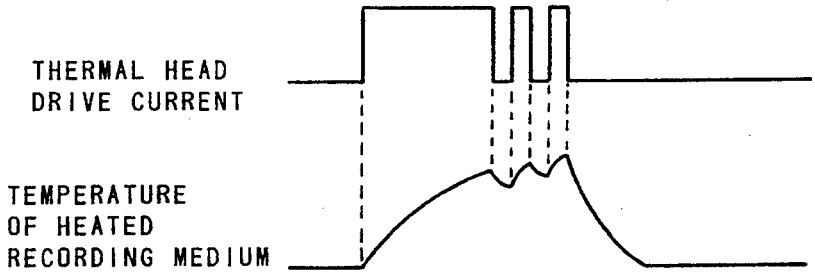
FIG. 10C is a diagram showing a thermal head drive current which is pulse-width-modulated and pulse-number-modulated and the temperature of a thermosensitive recording medium heated by the thermal head drive current.

In the above embodiments, each of the divided images is recorded by pulse-width modulation or pulse-number modulation. If an image of a high density is recorded by only pulse-width modulation, then the thermal head 14 will be heated for a long period of time, thus excessively heating the thermosensitive recording medium S as shown in FIG. 10A. The thermal head 14 itself will also be excessively heated, and its service life will be shortened. On the other hand, if an image of a high density is recorded by only pulse-number modulation, then the thermal head 14 and the thermosensitive recording medium S will not be excessively heated as shown in FIG. 10B, but the signals are turned on and off an increased number of times by the thermal head driver 22, resulting in a failure such as an operation delay which will cause irregularities in a recorded image.

Figure 11:
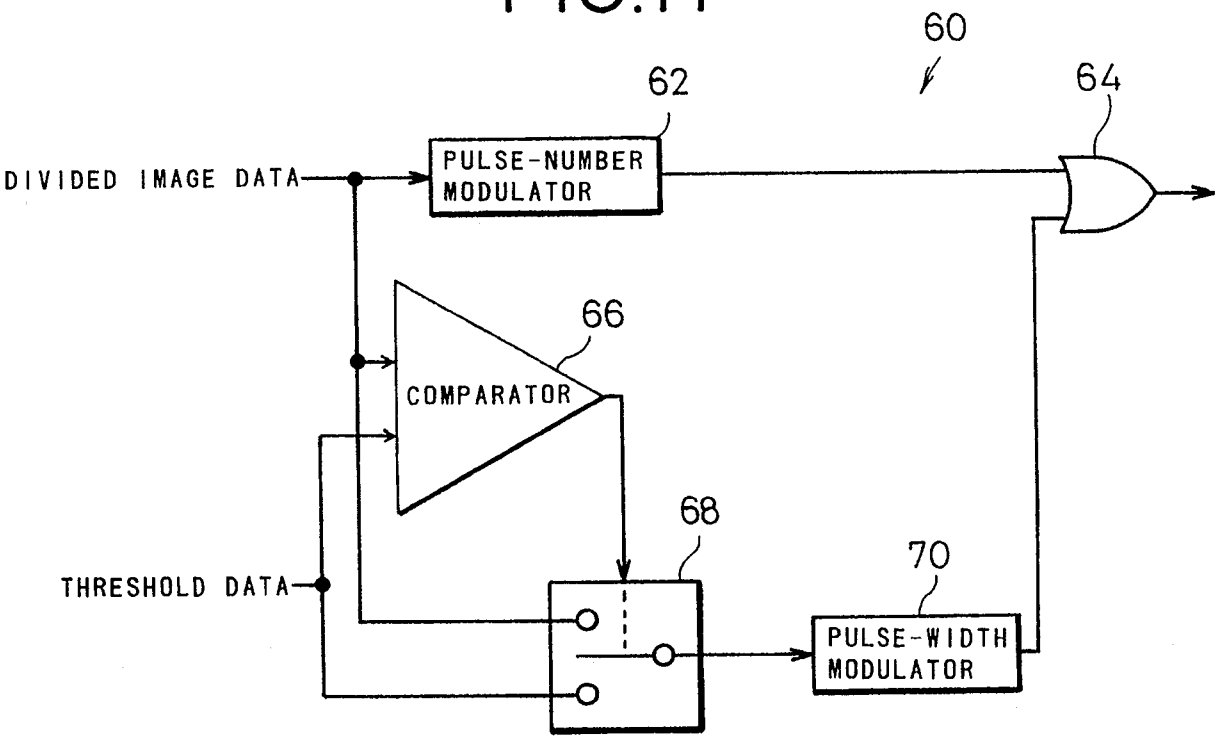
FIG. 11 is a block diagram of a combining circuit for generating the combined signal shown in FIG. 10C.

The above drawbacks can be eliminated by including a combining circuit 60 shown in FIG. 11 in the thermal head driver 22 shown in FIG. 1 or 6. More specifically, the divided image data supplied from the switcher 36 (58) are pulse-number-modulated by a pulse-number modulator 62, and the pulse-number-modulated divided image data are supplied to an OR gate 64. The divided image data supplied from the switcher 36 (58) are also supplied to a comparator 66 and compared thereby with threshold data used to switch from pulse-width modulation to pulse-number modulation. The comparator 66 compares the divided image data with the threshold data. If the divided image data are greater than the threshold data, then the comparator 66 supplies the divided image data through a switcher 68 to a pulse-width modulator 70. If the divided image data are equal to or smaller than the threshold data, then the comparator 66 supplies the threshold data through the switcher 68 to the pulse-width modulator 70. The pulse-width modulator 70 pulse-width-modulates either the divided image data or the threshold data, and supplies the pulse-width-modulated data to the OR gate 64.

Figure 12:
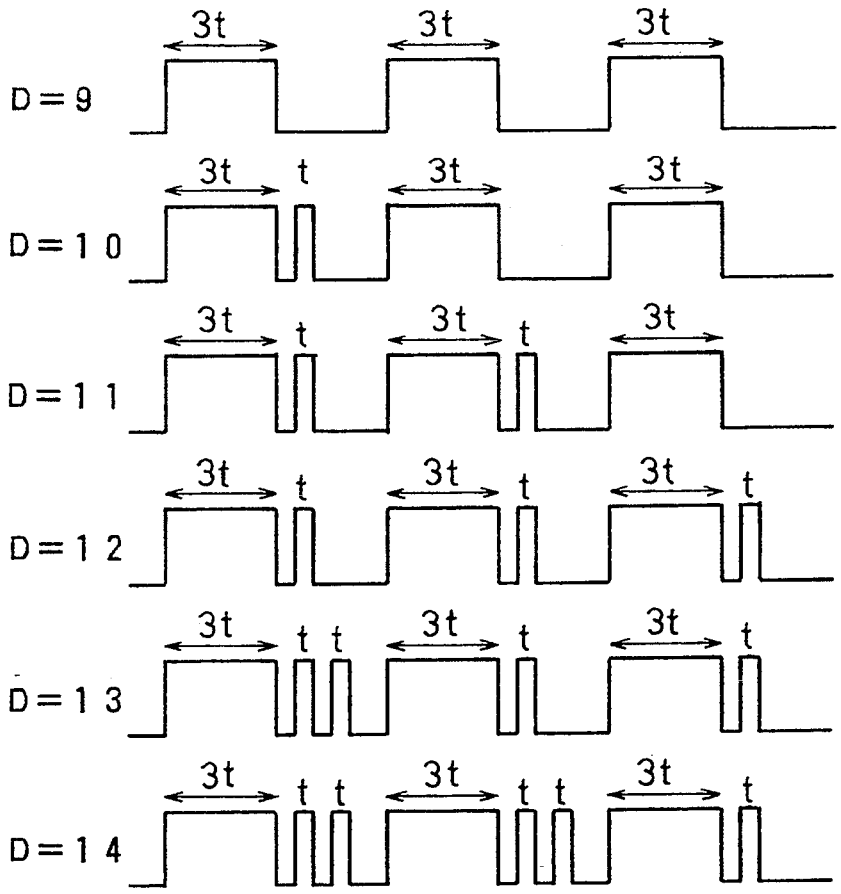
FIG. 12 is a diagram showing signals which are generated by the combining circuit shown in FIG. 11.

FIG. 12 shows, by way of example, drive signals supplied to the thermal head 14 based on an output signal from the OR gate 64 of the combining circuit 60 shown in FIG. 11. The threshold data are set to 3 with respect to each of divided image data which are produced when one-dimensional image data are divided by 3. For one-dimensional data with $D=0\sim9$, since divided image data produced from the one-dimensional data range from 0 to 3, an image is recorded by drive signals which are all pulse-width-modulated. For one-dimensional data with $D=10$ or more, inasmuch as four or more divided image data in excess of the threshold value of 3 are produced from the one-dimensional data, drive signals are generated by pulse-width-modulating the divided image data up to 3 and pulse-number-modulating the divided image data of 4 or more, and an image is recorded by such drive signals. As a consequence, when such an image is recorded, the thermosensitive recording medium S and the thermal head 14 are prevented from being excessively heated, and the thermal head driver 22 is prevented from suffering an undue burden.

Figure 13:
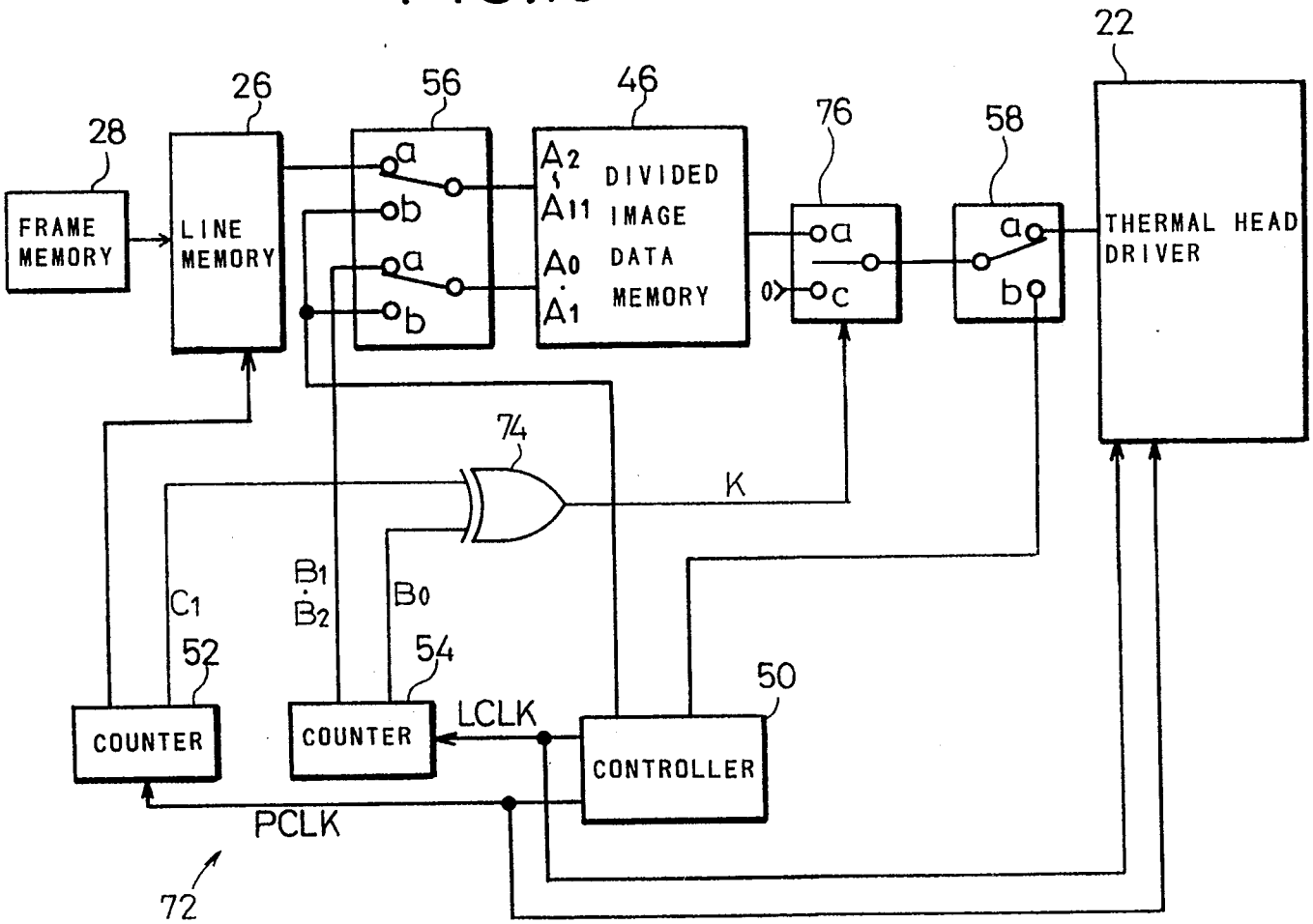
FIG. 13 is a block diagram of an image recording apparatus with a thermal head according to still another embodiment of the present invention.

FIG. 13 shows in block form an image recording apparatus 72 with a thermal head according to still another embodiment of the present invention. The image recording apparatus 72 is capable of recording a high-quality image which is free of undue concentrations by supplying drive currents at different times to adjacent ones of a plurality of heating elements 20 of the thermal head 14. Those parts of the image recording apparatus 72 which are identical to those of the image recording apparatus 40 shown in FIG. 6 are denoted by identical reference numerals, and will not be described in detail below. In FIG. 13, a switcher 76 is connected between the divided image data memory 46 and the switcher 58 for selectively supplying divided image data and a signal of 0 to the thermal head driver 22 according to a timing signal supplied through an exclusive-OR gate 74. The exclusive-OR gate 74 has an input terminal supplied with data $C_1$ (the 2nd bit, counted from the LSB, of the output signal from the counter 52), which have a frequency that is $\frac{1}{2}$ of the frequency of the pixel clock signal PCLK, from the counter 52, and another input terminal supplied with a signal $B_0$ which is the LSB of the output signal from the counter 54.

Figure 14:
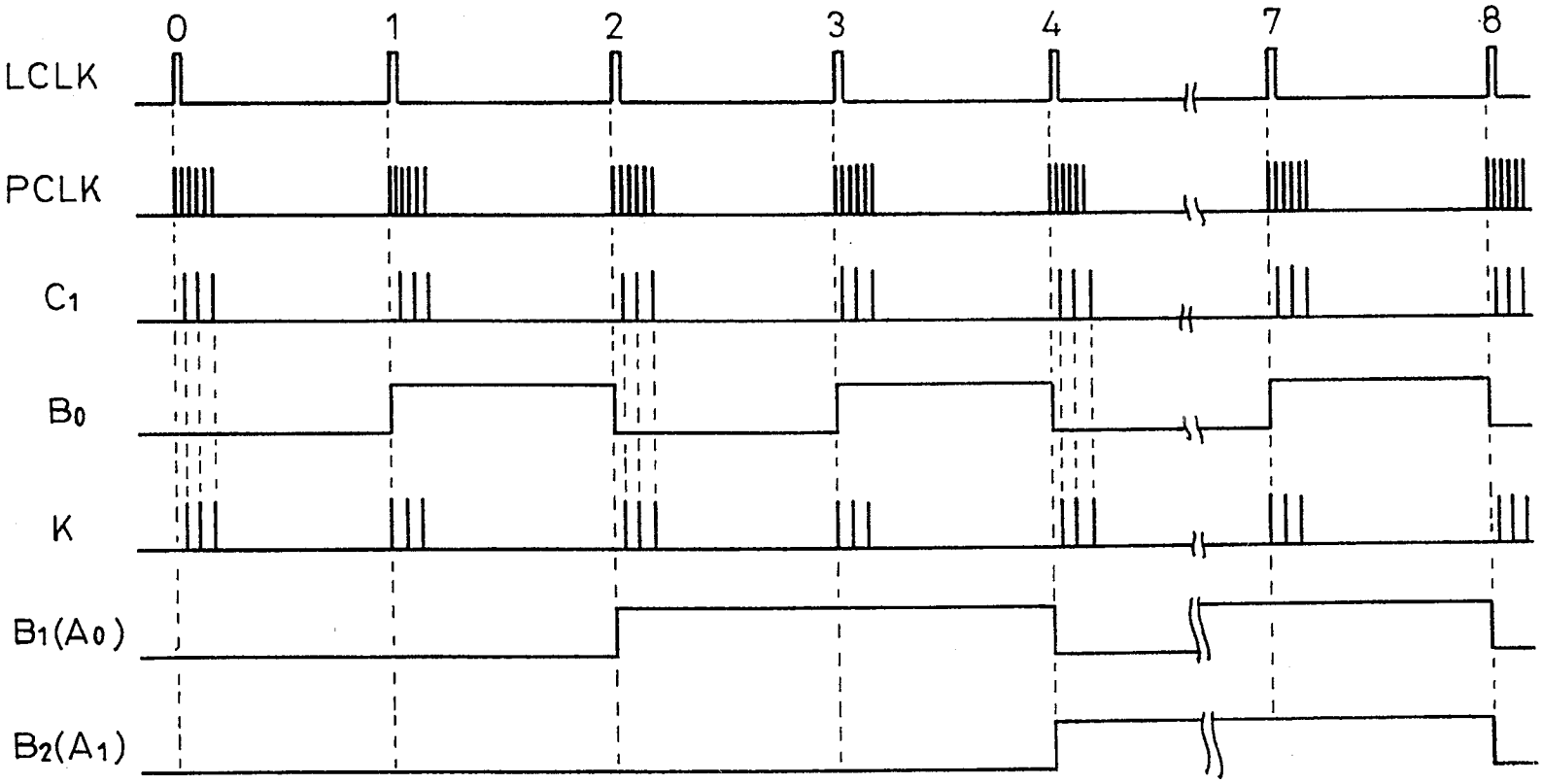
FIG. 14 is a timing chart of signals in the image recording apparatus shown in FIG. 13.

The image recording apparatus 72 records an image according to a timing chart shown in FIG. 14.

To record a first pixel on a 0th line, one of the input terminals of the exclusive-OR gate 74 is supplied with data $B_0$ of 1 which is the LSB of the output signal from the counter 54, and the other input terminal of the exclusive-0R gate 74 is supplied with the second data $C_1$ of 0 which is the second bit from the LSB of the output signal from the counter 52. Therefore, the exclusive-OR gate 74 supplies data K of 1 to the switcher 76. The movable contact of the switcher 76 is now connected to a contact "c" thereof, supplying a signal of 0 to the thermal head driver 22. As a result, as indicated by a mark "○" in FIG. 15, the thermal head 14 records nothing as the first pixel on the 0th line. In FIG. 15, data marked with "○" indicate signals of 0 supplied from the switcher 76.

To record a second pixel on the 0th line, since $B_0=1$ and $C_1=1$, the exclusive-OR gate 74 supplies data K of 0 to the switcher 76. The movable contact of the switcher 76 is connected to a contact "a" thereof, and the line memory 26 supplies one-dimensional image data of the second pixel as address data to the ten high-order bits $A_2 \sim A_{11}$ of the divided image data memory 46. The two low-order bits $A_0$, $A_1$ of the divided image data memory 46 are supplied with thrid and fourth data $B_2=B_3=0$, counted from the LSB, of the output signal from the counter 54. Therefore, the divided image data memory 46 supplies divided image data for the 0th line through the switchers 76, 58 to the thermal head driver 22. As a result, an image is recorded on the thermosensitive recording medium S based on the divided image data relative to the second pixel. Similarly, the switcher 76 is operated based on the data $C_1$ from the counter 52 to record every other image based on divided image data for even-numbered lines with respect to the 0th line.

When a line clock signal LCLK for recording a 1st line is supplied to the counter 54, since the data $B_0$ of the counter 54 becomes 0, the data K outputted from the exclusive-OR gate 74 are reversed from those for recording the 0th line, and every other divided image data for odd-numbered lines are supplied to the thermal head driver 22. Since the data $B_1$, $B_2$ supplied to the two low-order bits $A_0$, $A_1$ of the divided image data memory 46 remain to be 0, the divided image data for the 0th line shown in FIG. 7 serve as the divided image data for odd-numbered lines and are supplied as the divided image data for the 1st line to the thermal head driver 22. Now, every other image based on divided image data for odd-numbered lines with respect to the 1st line is recorded.

In this manner, images are formed which are displaced, pixel by pixel, in one-dimensional direction. In the embodiment shown in FIG. 13, the switcher 76 is employed to form every other image. However, the divided image data memory 46 may have an MSB address $A_{13}$, the exclusive-OR gate 74 may supply its output signal to the MSB address $A_{13}$, and all divided image data indicated by the MSB address $A_{13}$ may be set to 0. Such a modification also makes it possible to record every other image data.

Figure 16:
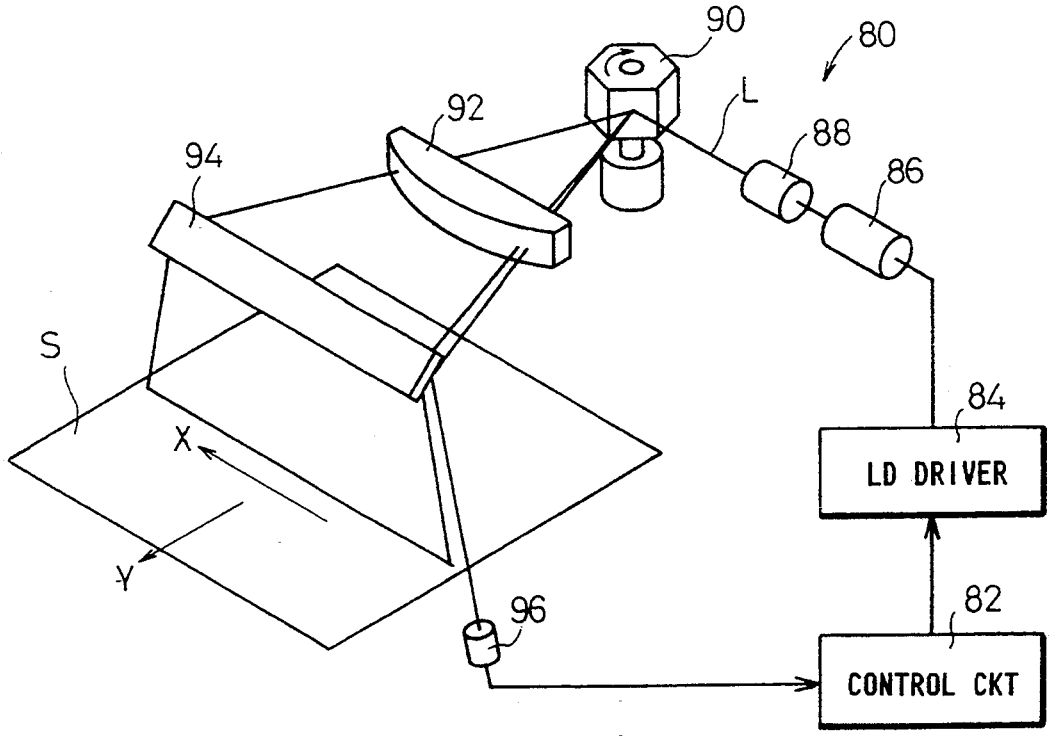
FIG. 16 is a block diagram of an image recording apparatus with a laser beam in which the principles of the present invention are embodied.
Figure 17A:
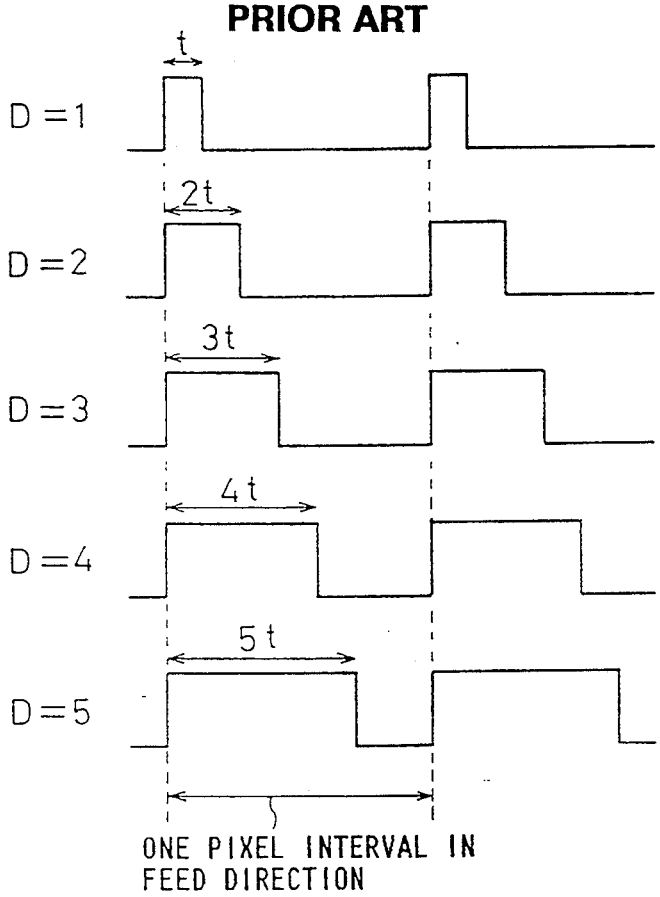
FIG.17A PRIOR ART
FIG. 17A is a diagram illustrative of drive signals which are pulse-width-modulated according to a conventional image recording process.
Figure 17B:
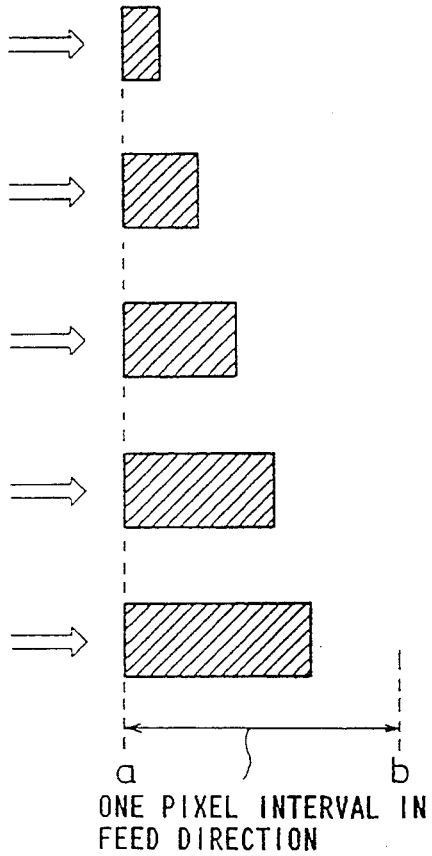
FIG.17B PRIOR ART
FIG. 17B is a diagram illustrative of an image produced by the drive signals shown in FIG. 17A.

FIG. 16 shows an image recording apparatus 80 with a laser beam in which the principles of the present invention are embodied. In the image recording apparatus 80, a laser diode 86 is controlled by an laser diode (LD) driver 84 under the control of a control circuit 82 for emitting a laser beam L which is modulated in intensity according to image data. The modulated laser beam L is converted by a collimator lens 88 into a parallel beam, which is then reflected and deflected by a light deflector 90. The deflected laser beam L is then applied to a thermosensitive recording medium S by an $f\theta$ lens 92 and a reflecting mirror 94. At the same time, the thermosensitive recording medium S is fed in an auxiliary scanning direction indicated by the arrow Y by an auxiliary scanning means (not shown). Therefore, when the surface of the thermosensitive recording medium S is scanned in the main scanning direction indicated by the arrow X by the laser beam L, a two-dimensional image is formed on the thermosensitive recording medium S.

The control circuit 82 employs a signal from a light detector 96 positioned in a location where the laser beam L starts a main scanning cycle, as a timing signal TS1 corresponding to the timing signal TS1 shown in FIG. 1, and generates timing signals TS2, TS3 corresponding to the timing signal TS2, TS3 shown in FIG. 1. Based on these timing signals TS1, TS2, TS3, the control circuit 82 divides image data D into three substantially equal sets of image data $d_1$, $d_2$, $d_3$, and supplies drive currents to the LD driver 84 based on these image data $d_1$, $d_2$, $d_3$. Based on the supplied drive currents, the LD driver 84 energizes the laser diode 86 for forming an image composed of three lines on the thermosensitive recording medium S within one pixel interval in the feed direction thereof. As with the image recording apparatus 10 with the thermal head 14, the image recording apparatus 80 can form a high-quality image free of coarse image textures on the thermosensitive recording medium S.

Although certain preferred embodiments of the present invention has been shown and described in detail, it should be understood that various changes and modifications may be made therein without departing from the scope of the appended claims.

What is claimed is:

1. A method of recording an image on a recording medium, comprising the steps of:

recording an image on a recording medium in a first one-dimensional direction with an image recording means and moving either the recording medium or the recording means in a second direction substantially perpendicular to said first one-dimensional direction;

dividing gradation image data of pixels of said image into a plurality of substantially equal sets of image data; and dispersing the image in said second direction based on said substantially equal sets of image data, thereby to record the image on the recording medium.

2. A method according to claim 1, further comprising the step of:

recording the dispersed image by pulse-width-modulating said substantially equal sets of image data.

3. A method according to claim 1, further comprising the step of:

recording the dispersed image by pulse-number-modulating said substantially equal sets of image data.

4. A method according to claim 1, further comprising the step of:

recording the dispersed image by pulse-width-modulating part of said substantially equal sets of image data and pulse-number-modulating the remainder of said substantially equal sets of image data.

5. A method according to claim 1, further comprising the step of:

recording image data which are adjacent to each other in said first one-dimensional direction and dispersed in said second direction, at different times from each other on said recording medium.

6. A method according to claim 1, wherein said step of dividing comprises the step of dividing gradation image data D into N substantially equal sets of image data $d_1, d_2, \ldots d_N$ based on the following relationship:

$$\begin{aligned} D &= d_1 + d_2 + \ldots + d_N \\ &= [D/N] + [(D - d_1)/(N - 1)] + \\ &\quad [(D - d_1 - d_2)/(N - 2)] + \ldots + \\ &\quad [(D - d_1 - d_2 \ldots - d_{N-1})]. \end{aligned}$$

7. An image recording apparatus comprising:

image recording means for recording an image in a first one-dimensional direction on a recording medium;

moving means for moving either said recording medium or said image recording means in a second direction substantially perpendicular to said first one-dimensional direction;

image data dividing means for dividing image data of pixels of the image into a plurality of substantially equal sets of image data;

divided image data memory means for storing the divided sets of image data;

image data selecting means for selecting image data stored in said divided image data memory means depending on a recording position in said second direction; and means for supplying the image data selected by said image data selecting means to said image recording means to record the image on the recording medium.

8. An image recording apparatus comprising:

image recording means for recording an image in a first one-dimensional direction on a recording medium;

moving means for moving either said recording medium or said image recording means in a second direction substantially perpendicular to said first one-dimensional direction;

divided image data memory means for dividing all image data which can be represented by pixels of the image into a plurality of substantially equal sets of image data, and storing the divided sets of image data for each recording line in said first one-dimensional direction;

selective signal generating means for generating a selective signal to select a recording line for the divided image data;

image data memory means for storing the image data of the pixels of the image; and means for selecting and supplying divided image data in said divided image data memory means to said image recording means based on the image data from said image data memory means and said selective signal from said selective signal generating means, thereby to record the image on the recording medium.

9. An image recording apparatus according to claim 8, further comprising:

selecting means for selecting either data of 0 or the divided image data from said divided image data memory means;

said selective signal generating means comprising means for generating a selective signal to select a recording line and control said selecting means to select said data of 0 at intervals of a predetermined number of pixels.

10. An image recording apparatus according to claim 8, wherein said divided image data memory means comprises means for storing a plurality of divided image data and data of 0 which record virtually no image on said recording medium, and said selective signal generating means comprises means for generating a selective signal to select a recording line and select said data of 0 at intervals of a predetermined number of pixels.

11. An image recording apparatus according to claim 7, wherein said image recording means comprises a thermal head composed of an array of heating elements arranged in said first one-dimensional direction.

12. An image recording apparatus according to claim 8, wherein said image recording means comprises a thermal head composed of an array of heating elements arranged in said first one-dimensional direction.

13. An image recording apparatus according to claim 7, wherein said image recording means comprises a laser scanning optical system for scanning a laser beam in said first one-dimensional direction.

14. An image recording apparatus according to claim 8, wherein said image recording means comprises a laser scanning optical system for scanning a laser beam in said first one-dimensional direction.

* * * * *